US005864122A

United States Patent [19]

Brandolini et al.

[11] Patent Number: 5,864,122

[45] Date of Patent: Jan. 26, 1999

[54] MULTIZONE LAUNDRY IRON AND METHOD FOR THE THERMAL REGULATION OF THE HOT PART

[75] Inventors: Jean-Louis Brandolini, Saint-Etienne; Dominique Gelus, Eyzin-Pinet, both of France

[73] Assignee: SEB S.A., Ecully, France

[21] Appl. No.: 836,810

[22] PCT Filed: Nov. 24, 1995

[86] PCT No.: PCT/FR95/01555

§ 371 Date: May 21, 1997

§ 102(e) Date: May 21, 1997

[87] PCT Pub. No.: WO96/17122

PCT Pub. Date: Jun. 6, 1996

[30] Foreign Application Priority Data

Nov. 25, 1994 [FR] France ..... 94 14417

[51] Int. Cl.[6] ..... H05B 1/02

[52] U.S. Cl. ..... 219/483; 219/255; 219/505; 38/77.8

[58] Field of Search ..... 219/250–253, 219/483, 486, 501, 497, 505, 506, 255; 340/555, 573; 38/77.3, 77.7, 77.8

[56] References Cited

U.S. PATENT DOCUMENTS

| | | | |
|---|---|---|---|
| 2,345,413 | 3/1944 | Morton | 38/77 |
| 2,970,394 | 2/1961 | Braumbaugh | 38/77 |
| 3,110,975 | 11/1963 | Kircher . | |
| 4,716,276 | 12/1987 | Motegi et al. | 219/253 |
| 4,939,342 | 7/1990 | Frens et al. | 219/251 |
| 5,380,983 | 1/1995 | Cavada et al. | 219/250 |
| 5,463,205 | 10/1995 | Sham et al. | 219/502 |

FOREIGN PATENT DOCUMENTS

| | | |
|---|---|---|
| 41 07 236 A1 | 10/1992 | Germany . |
| 2 006 835 | 5/1979 | United Kingdom . |

*Primary Examiner*—Mark H. Paschall
*Attorney, Agent, or Firm*—Pillsbury Madison & Sutro

[57] ABSTRACT

Electric steam iron having a hot part (1) composed of a sole (7) and a steam chamber (4), the sole having a portion situated under the steam chamber, and the hot part (1) of the iron being subdivided into at least two thermal zones. A plurality of heating elements are each disposed to heat a respective one of the thermal zones and a plurality of regulation organs are each associated with a respective one of the heating elements. The at least two thermal zones include a first thermal zone (A) having at least one surface corresponding substantially to the steam chamber (4) and a second thermal zone (B) having at least one surface corresponding substantially to the portion of the sole situated under the steam chamber, the first thermal zone (A) and the second thermal zone (B) being in thermal communication with one another. The heating element which is disposed to heat the first thermal zone is arranged to at least partially heat the second thermal zone.

16 Claims, 1 Drawing Sheet

MULTIZONE LAUNDRY IRON AND METHOD FOR THE THERMAL REGULATION OF THE HOT PART

TECHNICAL FIELD

The present invention relates to the general technical field of appliances conceived for the care of a textile article, such as a clothing article, by subjecting it to the combined action of a thermal treatment, a mechanical pressing treatment and a steam treatment.

The present invention concerns an electric steam iron comprising a hot part composed of a sole and a steam chamber, said hot part of the iron being subdivided into at least two thermal zones, each of them being provided with a heating element and associated with a control organ.

PRIOR ART

In pressing irons of the prior art, the thermal energy transmitted to the pressing sole is conventionally furnished by heating elements such as tubular heating elements, or even by heating elements of the flat type including a resistive strip. In this latter case the resistive strip forms a heating circuit defining on the pressing sole a heating zone, said strip being inserted between two electrically insulating films adhering to one another and also maintaining the resistive strip in place. In one case or the other, it is important to maintain or control the temperature of the pressing sole below an assigned temperature. To this end, it is conventional to use regulation means or temperature sensors, for example a thermostat, disposed in the pressing iron in thermal communication with the heating element. As a general rule the thermostat or any other temperature regulation or control organ is disposed in thermal communication with the heating element in a previously selected zone and often as close as possible to the zone identified as being the hottest at the level of the sole. In effect, it is in order to be careful to avoid or at least limit the conventional problem of exceeding frequently occurring in pressing irons.

Such a phenomenon is produced when the temperature control or regulation organ only records or controls a thermal image of the heating element which is shifted in time and/or in space. This occurs when the thermostat is for example situated in a zone which is too far from the heating element, in such a manner that the thermostat is triggered at the correct assigned temperature but too late, at least a portion of the pressing sole being already at a temperature greater than the assigned temperature. In order to remedy at least in part this conventional phenomenon of thermal disfunctioning, it is consequently well-known to systematically fix the temperature control or regulation organs in the zone of the heating element known to be the hottest.

This solution presents however inconveniences. On the one hand, determination of the hottest zone of a heating element, or even of a pressing iron sole is not always sufficiently precise and can even vary from one appliance to another. On the other hand, the necessity of systematically placing the temperature control organ in the hottest zone of the appliance constitutes an additional fabrication constraint limiting the possibilities of arranging and mounting the other organs of the appliance. This solution is that much more constraining, notably in pressing irons, when the volume available for mounting the different organs necessary for the functioning of the appliance is limited. This constraint thus constitutes a negative factor with regard to the freedom of design and arrangement of the organs in the available volume.

French Patent Application No. 2,691,723 discloses a household appliance particularly a pressing iron in which control of the temperature is improved. For this it comprises a heating element including at least one resistive strip forming a heating circuit delimiting a heating surface, and a temperature control or regulation organ disposed in thermal communication with said heating element, said heating surface comprising at least one local overheating zone opposite which is disposed the temperature control or regulation organ.

Nevertheless, despite the advance provided by such an arrangement and with the objective of offering an operator the best possible utilization comfort of a pressing iron for a further improved pressing, it has been determined that control of the temperature of the sole could be further improved.

In effect, in most of the appliances known in the prior art, including in that described in the above-cited application, the regulation/heating circuit is unique. Consequently, the associated regulation organ can have only a partial image of the temperature of the iron sole. It is a question of the temperature existing at the precise location where this regulation organ is fixed. This organ thus activates the heating element when the temperature of the point on which it is fixed passes below an assigned value, without taking into account the temperature differences which exist between different points of the sole.

In any event, even if one were to resolve this problem, for example by placing several temperature probes at different points of the sole, and by averaging the values, the heating element being unique, one will not dispose heating means in a selective fashion certain zones of this sole. To the contrary, by resupplying the heating element, on will supply calories to the heating element, without taking into account the real temperature state of each zone. One will thus maintain, even aggravate, the temperature distortion state in which the sole is found.

There are equally known irons whose sole is composed of two thermal zones each composed of a heating element. The document GB-2 006 835 describes such an iron, composed of a frontal zone and a rear zone. This configuration aims at compensating the substantial thermal losses undergone by the frontal region, in general highly solicited.

Moreover, an having a hot part composed of a sole and a steam chamber, the sole and the steam chamber each being provided with a heating element iron is known from the document U.S. Pat. No. 3,110,975.

In the case of steam irons where a heating element is associated with the steam chamber (in general only one serving at the same time to furnish heat energy for the vaporization of water and to heat the sole), applicant has noted and confirmed by thermographs that the part of the sole plate located under the steam chamber is substantially colder than the rest of the surface of the sole, in particular during the vaporization operation. This situation is troublesome since it is desired in general that the surface of the sole of the iron attain its optimum temperature at the moment when the steam is emitted.

SUMMARY OF THE INVENTION

The object of the invention is thus to provide a steam iron such that one can manage in a selective fashion the temperature of several different zones of the hot part of the iron either of the sole and/or of the steam chamber. One can thus, by construction, by disposing as many thermal regulation organs and by managing in an adapted manner these regulations, eliminate or attenuate the cold zone situated below the steam chamber. One will thus achieve a sole capable of vaporizing water while maintaining a temperature at all points adapted to the fabric. In addition, one can optimize the efficiency of the steam chamber and provide a pressing iron capable of vaporizing large quantities of water (greater than 30 grams/minute) and steam iron synthetic fabrics for which the temperature of the sole in contact with the linen must remain around 100° C.

Another object of the invention consists in proposing a pressing iron whose sole comprises several temperature zones capable of being managed in an independent manner in order to be able to be situated at different temperature levels with respect to one another.

These objects are achieved according to the invention concerning an electric steam pressing iron comprising a hot part composed of a sole and a steam chamber, said hot part of the iron being subdivided into at least two thermal zones A, B, C, each of them being provided with a heating element and associated with a regulation organ characterized on the one hand in that the first zone A comprises at least one surface corresponding substantially to the steam chamber and on the other hand in that a second zone B comprises at least one surface corresponding substantially to the portion of the sole situated under the chamber.

The thermal losses due to vaporization are thus compensated by the heating element disposed between the steam chamber and the sole. This element permits to avoid the creation of a cold zone under the steam chamber in the case where this latter absorbs a substantial quantity of thermal energy.

According to an advantageous form of construction of the invention, the regulation element associated with zone B is provided to activate the heating element associated with zone B in particular during steam generation. Since the risk of appearance of the cold zone is less at the moment of vaporization, one suppresses the risk by furnishing additional thermal energy at the most critical moment.

According to another advantageous form of construction of the invention at least one of said heating elements is associated with a mechanical and/or electronic vaporization control. Preferably, this heating element is that corresponding to zone B situated under the steam chamber. This manner of control assures that the thermal energy of the sole will not be absorbed by the vaporization process. The user does not have to be preoccupied with the temperature of the sole, the heating being controlled automatically during the steam generation.

According to another advantageous form of construction of the invention, the first zone A equally comprises at least one portion of the surface corresponding substantially to the portion of the sole not covered by said steam chamber. One can in this manner assure the temperature setting of the portion of the sole situated for example at the rear of the steam chamber, without necessarily continually using the second heating element.

According to another advantageous form of construction of the invention the hot part comprises a third thermal zone C provided with a heating element and associated with a regulation organ, said zone being disposed preferably in proximity to the peripheral edge of the sole. One can thus create a thermal map of the sole according to a multitude of possibilities.

According to another advantageous form of construction of the invention, the second heating element is substantially flat. It is then easy to integrate it into the reduced space located between the steam chamber and the sole.

The objects of the invention are also achieved due to a method of thermal regulation for an electric steam pressing iron, in which the heating element is regulated in a manner to avoid the formation of a cold zone at the level of the sole, notably during steam generation.

According to a preferred variant of the thermal regulation method for an electric steam pressing iron, the setting of the temperature of zone A is assured by a first heating element and that of the zone B at the same time by the first heating element and by a second distinct heating element. The second heating elements thus serves as a supplemental heating means.

According to another preferred variant of the thermal regulation method for an electric steam pressing iron, the setting of the temperature of zone A is assured by a first distinct heating element and that of the zone B by a second distinct heating element. This manner of regulation permits a great flexibility at the level of the management of the thermal map of the sole.

The present invention equally concerns characteristics which will appear during the course of the description which follows, and which should be considered individually or according to all of their possible technical combinations.

BRIEF DESCRIPTION OF THE DRAWINGS

Other characteristics and advantages of the invention will appear more clearly in the light of the description and the drawings which follow, illustrating, by way of nonlimiting examples, embodiments of the invention. Thus, reference is made to FIGS. 1 to 3 where.

BEST MANNER OF ACHIEVING THE INVENTION

According to a first preferred form of construction of the invention, a steam chamber 4 is formed in the hot part 1 of the iron. A first heating element 2, preferably tubular, is inserted by overmolding, by fitting in a groove, or by any other means on a support 3. This support 3 is most often made of molded aluminum, but it is obvious that this material can be replaced by any other material whose conductivity characteristics are advantageous.

This support delimits in addition steam chamber 4. This chamber communicates in a conventional manner with a reservoir (not shown) supplying the water necessary for the production of steam. According to the form of construction, it can be a matter of a reservoir integrated into the iron, or a reservoir of the external type, both of these types being known. The steam chamber can equally be connected to an external steam generator equally of a known type.

Figure 1:
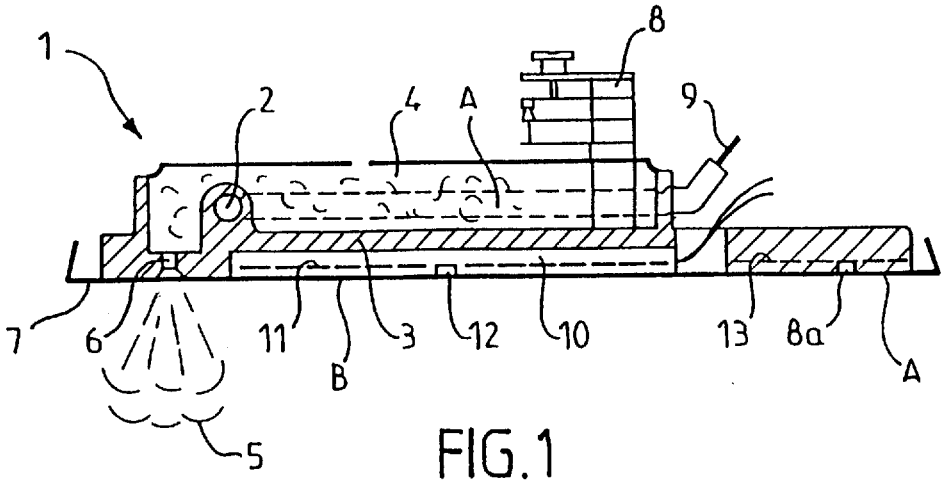
FIG. 1 is a view in cross section of the hot part of a pressing iron according to the invention.
Figure 2:
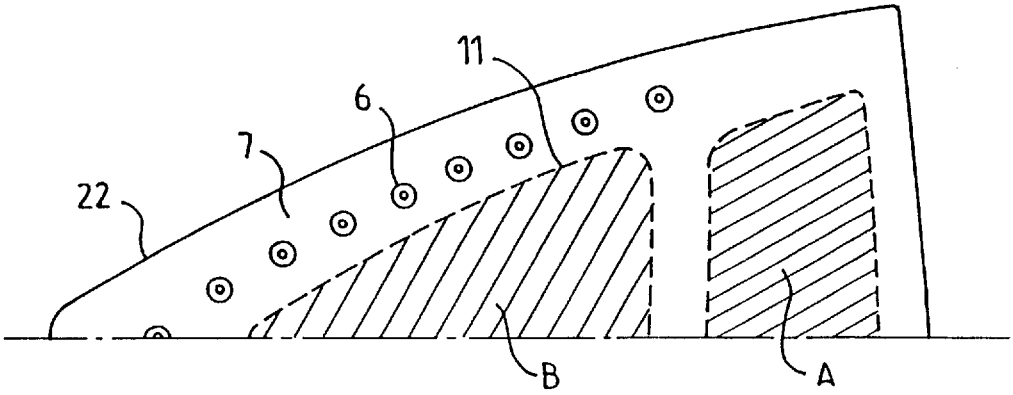
FIG. 2 is a partial bottom view of a pressing iron according to FIG. 1.

A regulation organ 8 or thermostat cooperates thermally with steam chamber 4. This heating element 2 is supplied by the intermediary of an electric supply source 9 in a manner to furnish the heat energy necessary on the one hand for the vaporization of water and on the other hand for the heating of the sole. This first heating element 2 acts in particular on a zone "A" of the hot part corresponding substantially to the steam chamber and possibly to another portion of the sole, not covered by the steam chamber (FIGS. 1 and 2).

In the embodiment examples described, the rear portion of the sole not covered by the steam chamber, is designated A when it is brought to its temperature by the same heating element as zone A, and A' when it possesses a distinct heating element.

Moreover and in a completely independent manner, hot part 1 comprises at its lower part another heating element 11 preferably flat, defining a zone "B" corresponding substantially to the portion of the sole situated under chamber 4. The flat heating element 11 is housed in a recess 10 arranged between support 3 and sole 7. According to an advantageous form of construction of the invention, the heating element of zone "B" is intended to compensate the "thermal losses" provoked by the vaporization, tending to give rise to an at least partial cooling in this zone.

Flat hot part 1 is controlled by regulation organ or thermostat 12 independently of the above-cited thermostat 8 of steam chamber 4. The regulation can equally be effectuated electronically. According to variations envisioned, the regulation can permit the heating of zone "B" in a manner entirely independent of zone "A", or even in complement of heating element when this is necessary, notably during steam generation. According to another variant, a complementary regulation organ 8*a*, disposed at the level of part "A" of the sole can complete the regulation of zone "A", for example in order to avoid exceeding certain given temperature limits.

Flat heating element 11 is preferably flexible and made according to a conventional technique. It includes at least one resistive strip made of any material which is a good conductor of heat, such as aluminum, copper, constant an, for example said strip forming a heating circuit whose exterior envelope interiorly delimits a heating surface. The resistive strip is in a known manner either inserted between two electrical insulating films adherent to one another for example by cementing and maintaining the strip in place. The electrical insulating films can be selected from among all known insulating materials such as PVC, polyester, polyamide, silicone, micanite, etc.

In the preferred application envisioned, the heating element is substantially flat. One can however utilize a traditional heating element, for example of the tubular type.

The heating element represented is intended to be integrated into a pressing iron by cementing between the pressing sole itself and an upper support plate.

According to this embodiment example, hot part 1 of the iron is subdivided in fact into two zones "A" and "B", in a preferred manner mechanically joined together to one another. The arrangement is provided so that the different zones are preferably substantially thermally independent: zone "B" being provided with a distinct heating element 11 which belongs to it, associated with a regulation organ 12 independent of regulation organ 8 of heating element 2 of zone "A". It is then possible to manage in a selective fashion the temperature of said zones "A" and "B" independently of one another, as a function of a desired thermal cartography of the sole.

In the case of the form of construction shown in FIG. 1, it is advantageous that the two defined thermal zones not be isolated from one another in order to facilitate the thermal transfers. This configuration permits utilization of flat heating element 11 solely as supplement. Thus, in such a case, the heating element under the steam chamber can be activated only during steam generation in order to avoid the creation of the cold zone previously described. Outside of the steam generation period, the heating element associated with the steam chamber then equally assures heating of all of the sole.

Control of heating element 11 can equally be associated with a mechanical and/or electronic steam generation control.

According to another variant, zones "A" and "B" are substantially insulated from one another; establishment of the temperature in zone "B" can then only be achieved by heating element 11 associated with this zone.

Starting from these basic examples, all variations can be enumerated.

In the same manner, according to the possible variations, heating element 11 disposed under chamber 4 is maintained at a fixed temperature, or is controlled by a regulation organ 12 such as described previously.

According to another variation, one can equally provide that the heating element 11 disposed under chamber 4 and/or heating element 2 of the steam chamber are placed under voltage in an alternating manner by the intermediary of a device (not shown) for detecting the presence of the hand of the operator, in a manner to assure their operation only during a period of work, to the exclusion of rest periods in the pressing cycle adopted.

According to another variation of the invention, heating element 2 of steam chamber 4 is regulated either as a function of a fixed instructions, or as a function of a variable instruction determined by the operator, or linked to a physical quantity.

According to another variation of the invention, heating element 11 situated under chamber 4 is a flat heating element while heating element 2 situated in steam chamber 4 is a tubular heating element.

Figure 3:
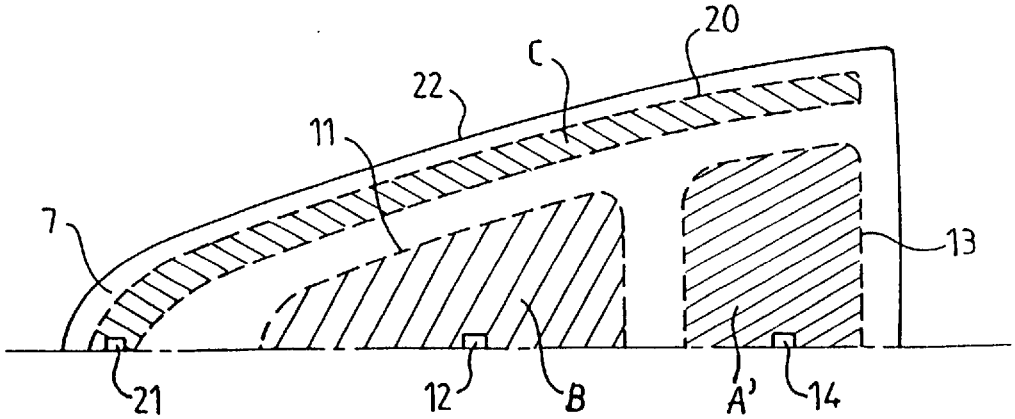
FIG. 3 is a partial bottom view of a pressing iron according to a modified embodiment of the thermal zones of the hot part.

In another form of construction represented in FIG. 3, heating element 2 is always composed of a first zone A corresponding substantially to steam chamber 4, but sole 7 is composed of two thermal zones "A'" and "B" situated respectively behind and in front of said sole 7 to which is added a third thermal zone "C" disposed in proximity to its peripheral edge 22, each of said zones "A", "A'", "B" and "C" being raised in temperature by the intermediary of distinct heating elements 11, 13, 20 and 2, controlled independently of one another by respective regulation organs 12, 14, 21, 8, as a function of the desired temperature cartography of the sole.

It is thus that the different thermal zones "A'" , "B" and/or "C" of the heating circuit of sole 7 comprise flat heating elements 11, 13, 20 attached on sole 7, either directly or by the intermediary of an attached plate.

The different thermal zones "A'", "B" and/or "C" of the heating circuit of sole 7 can equally comprise tubular heating elements (not shown) attached on sole 7 either directly or by the intermediary of an attached plate.

The different thermal zones "A", "A'", "B" and/or "C" of the heating circuit of the sole can also comprise flat heating elements 11, 13 and/or tubular.

Advantageously regulation organs 12, 14, 21, 8 of the different heating elements are connected to control means arranged to permit a programming of the temperature gradients chosen as a function of the different zones of sole 7 in order to modulate the pressing temperature depending on the fabrics.

The means employed by the invention and which have just been described hereabove can permit on the one hand avoiding the cold zone situated under the steam chamber, and on the other hand obtaining at the same time a perfectly uniform temperature of the pressing iron sole and a rigorous control of intentionally different temperature zones, for example to achieve a front attach zone which is hotter than a rear zone.

POSSIBILITIES OF INDUSTRIAL APPLICATION

The present invention finds its application in the construction of an electric steam pressing iron comprising a hot part 1 composed of a sole 7 and a steam chamber 4, said hot part 1 of the iron being subdivided into at least two thermal zones A, B, C, each of them being equipped with a heating element 11, 13, 20 and associated with a regulation organ 12, 14, 21.

We claim:

1. Electric steam iron comprising: a hot part (1) composed of a sole (7) and a steam chamber (4), said sole having a portion situated under said steam chamber, said hot part (1) of the iron being subdivided into at least two thermal zones (A, A', B, C); a plurality of heating elements (2, 13, 11, 20) each disposed to heat a respective one of the thermal zones; and a plurality of regulation organs each associated with a respective one of said heating elements (8, 14, 12, 21), the at least two thermal zones including a first thermal zone (A) comprising at least one surface corresponding substantially to the steam chamber (4) and a second thermal zone (B) comprising at least one surface corresponding substantially to the portion of said sole situated under said steam chamber, the first thermal zone (A) and the second thermal zone (B) being in thermal communication with one another, wherein said heating element which is disposed to heat the first thermal zone is arranged to at least partially heat the second thermal zone.

2. Iron according to claim 1, in which the regulation organ (12) associated with the heating element disposed to heat the second thermal zone (B) is provided to activate that heating element during steam generation.

3. Iron according to claim 1, in which at least one of said heating elements is associated with at least one of a mechanical and electronic steam generation control.

4. Iron according to claim 3, in which said at least one of said heating elements is that corresponding to said second thermal zone.

5. Iron according to claim 1, wherein a portion of said sole is not situated under said steam chamber and the first zone (A) comprises equally at least one surface portion corresponding substantially to the portion of the sole (7) not situated under said steam chamber (4).

6. Iron according to claim 1, wherein said sole has a peripheral edge, and said at least two thermal zones further comprise a third thermal zone (C) at which one of said plurality of heating elements is disposed, said third thermal zone being disposed in proximity to the peripheral edge of said sole.

7. Iron according to claim 1, wherein at least one of the heating elements (2, 11, 20) is susceptible to being turned on in alternation by the intermediary of a device for detecting the presence of the hand of the operator, in a manner to assure operation of said one of the heating elements only in a work period to the exclusion of rest periods of the pressing cycle adopted.

8. Iron according to claim 1, wherein the regulation organs (12, 14, 21, 8) of the different heating elements are connected to control means able to permit a programming of the temperature gradients chosen as a function of the different zones of the sole (7) in order to modulate the pressing temperature according to the fabrics.

9. Iron according to claim 1, wherein each of said heating elements is constituted by a resistive part.

10. Iron according to claim 1, wherein each of said heating elements is one of a flat heating element and a tubular heating element.

11. Iron according to claim 1, wherein said heating element which is disposed to heat said second thermal zone is substantially flat.

12. Thermal regulation method for regulating the electric steam iron defined in claim 1, comprising heating the first thermal zone by said heating element disposed to heat the first thermal zone, and heating the second thermal zone by said heating elements disposed to heat the first and second thermal zones.

13. Thermal regulation method according to claim 12 further comprising effecting thermal regulation in each of said thermal zones under control of only one respective one of said regulation organs.

14. Thermal regulation method according to claim 12 further comprising regulating said heating elements as a function of a fixed instruction.

15. Thermal regulation method according to claim 12 further comprising regulating said heating elements as a function of a variable instruction determined by the operator.

16. Thermal regulation method according to claim 12 further comprising regulating said heating elements as a function which is linked to a physical quantity.

* * * * *